US009522806B2

(12) United States Patent
Zapf et al.

(10) Patent No.: US 9,522,806 B2
(45) Date of Patent: Dec. 20, 2016

(54) DEFLECTION PULLEY COVER FOR MONITORING ELEVATOR CAR SUPPORT

(71) Applicant: Inventio AG, Hergiswil (CH)

(72) Inventors: Volker Zapf, Obernau (CH); Philipp Bürgi, Berlin (DE)

(73) Assignee: Inventio AG, Hergiswil (CH)

( * ) Notice: Subject to any disclaimer, the term of this patent is extended or adjusted under 35 U.S.C. 154(b) by 9 days.

(21) Appl. No.: 14/407,146

(22) PCT Filed: Jun. 26, 2013

(86) PCT No.: PCT/EP2013/063336
§ 371 (c)(1),
(2) Date: Dec. 11, 2014

(87) PCT Pub. No.: WO2014/001372
PCT Pub. Date: Jan. 3, 2014

(65) Prior Publication Data

US 2015/0158697 A1 Jun. 11, 2015

(30) Foreign Application Priority Data

Jun. 29, 2012 (EP) ..... 12174282

(51) Int. Cl.
*B66B 5/00* (2006.01)
*B66B 15/02* (2006.01)

(52) U.S. Cl.
CPC ..... *B66B 5/0031* (2013.01); *B66B 15/02* (2013.01)

(58) Field of Classification Search
CPC ..... B66B 5/0031; B66B 15/02
USPC ..... 187/266
See application file for complete search history.

(56) References Cited

U.S. PATENT DOCUMENTS 2,444,245 A * 6/1948 Campbell ..... B21B 38/06 73/862.454
3,780,989 A * 12/1973 Peterson ..... B63B 21/56 192/85.09
4,492,363 A * 1/1985 Niskin ..... B66D 1/36 254/275
4,690,380 A * 9/1987 Niskin ..... B66D 1/50 254/394
4,914,960 A * 4/1990 Kordahi ..... G01L 5/10 73/862.451
5,305,649 A * 4/1994 Larimore ..... E21B 47/04 73/862.391
6,715,587 B2 * 4/2004 Sittler ..... B66B 1/3484 187/277
8,602,173 B2 * 12/2013 Berner ..... B66B 5/125 187/250

(Continued)

FOREIGN PATENT DOCUMENTS

CH 09158772 * 4/2009
EP 1626026 A2 2/2006
EP 1772411 A1 4/2007

*Primary Examiner* — Michael Riegelman
(74) *Attorney, Agent, or Firm* — Fraser Clemens Martin & Miller LLC; William J. Clemens

(57) ABSTRACT

A support apparatus is guided in an elevator installation via a drive and a deflecting roller. A cover is arranged at the deflecting roller. The support apparatus running in or running out at the deflecting roller is at least partly covered by the cover. The cover is monitored by a monitoring device so that deformation of the cover by the support apparatus is ascertainable.

24 Claims, 2 Drawing Sheets

(56) References Cited

U.S. PATENT DOCUMENTS

| | | | | |
|---|---|---|---|---|
| 2008/0087502 | A1* | 4/2008 | Zapf | B66B 7/062 187/394 |
| 2009/0236184 | A1* | 9/2009 | Ueda | B66B 5/0031 187/247 |
| 2011/0308892 | A1* | 12/2011 | Saarelainen | B66B 15/02 187/266 |
| 2012/0024637 | A1* | 2/2012 | Henneau | B66B 5/12 187/394 |
| 2012/0138391 | A1* | 6/2012 | Weinberger | B66B 5/0031 187/251 |
| 2014/0121049 | A1* | 5/2014 | Nishikawa | B62M 6/55 474/148 |
| 2015/0158698 | A1* | 6/2015 | Moser | B66B 1/3492 187/266 |
| 2015/0336769 | A1* | 11/2015 | Dold | B66B 7/1223 187/393 |

* cited by examiner

DEFLECTION PULLEY COVER FOR MONITORING ELEVATOR CAR SUPPORT

FIELD

The present invention relates to an elevator installation with a monitoring device and to a method for monitoring a support means in an elevator installation.

BACKGROUND

Steel cables are conventionally used for supporting and/or driving an elevator car in elevator installations. According to a development of such steel cables, belt-like support means comprising tensile carriers and a casing arranged around the tensile carriers are also used. Such belt-like support means are, similarly to conventional steel cables, guided in the elevator installation over drive pulleys and deflecting rollers. However, by contrast to steel cables belt-like support means are not guided as a whole in grooves in the deflecting rollers or drive pulleys, but the belt-like support means lie substantially on the deflecting rollers or drive pulleys.

Support means do not always run in elevator installations exactly perpendicularly to the axis of deflecting rollers or drive pulleys. Occurrence of diagonal tension can be caused on the one hand by a construction or on the other hand by imprecise mounting of the elevator installation. Due to such diagonal tension of the support means there is the risk that the support means slips laterally off a deflecting roller or a drive pulley. In order to prevent this, elevated side edges are used at the deflecting rollers or drive pulleys or also longitudinal ribs and longitudinal grooves in support means as well as on the traction surface of the deflecting rollers or drive pulleys, which interengage and thus ensure lateral guidance.

However, it has proved that measures such as elevated side edges or longitudinal grooves in support means cannot prevent lateral jumping-off of the support means in every instance. Particularly in the case of support means with longitudinal ribs it was observed that the support means due to diagonal tension was laterally displaced by one or more longitudinal ribs so that the support means protruded laterally beyond the deflecting roller without entirely jumping off laterally. There is thus the risk that a support means at least partly laterally jumps off a deflecting roller or a drive pulley without this being recognized by the safety systems of the elevator installation.

SUMMARY

It is therefore an object of the present invention to make available an elevator installation in which at least partial lateral jumping of the support means off deflecting rollers is reliably recognized. Such a device shall in addition be economic and robust both in manufacture and in use. Moreover, it is an object of the present invention to provide a method of monitoring a support means in an elevator installation which reliably ascertains lateral jumping of the support means off a deflecting roller.

This object is fulfilled by an elevator installation in which a support means is guided via a drive and via a deflecting roller, wherein a cover is arranged at the deflecting roller and wherein the cover at least partly covers the support means running in or running out at the deflecting roller. The cover is monitored by a monitoring device so that deformation of the cover by the support means is ascertainable.

The use of a cover and a monitoring device coupled therewith has the advantage that an already existing element, namely the cover, can be used for a further function. Such covers of deflecting rollers are disclosed in, for example, the published specification EP 1626026 A1. They serve the purpose of preventing decoupling of the support means from the deflecting roller when the support means slackens. Slackening of the support means can arise, inter alia, in the case of an abrupt stop in an upward movement of the cage or in a case of settling of the car on a buffer. In such situations such a cover is sufficient to keep the support means on the deflecting roller. However, a support means which has laterally jumped off at least partly cannot be kept on by such a cover. An advantage of the proposed solution is thus to use an already present component for a further function.

Since the cover of the deflecting roller is designed to keep slack belts in position, such a cover deforms directly when a support means under load comes into contact with the cover. Such a cover can be a permanent deformation or also a temporary deformation. In the case of temporary deformation the cover distorts temporarily and then regains its original shape. In the case of a permanent deformation the cover breaks apart or elements of the cover distort without later regaining the original shape thereof. Permanent deformations can in addition also arise if the support means rubs against the cover so that this is permanently deformed at its surface by the abrasion and/or by the development of heat occurring in that case.

In order to be able to detect such a permanent or temporary deformation of the cover the monitoring device can in principle be designed in different ways. Depending on how the monitoring device is constructed, the monitoring device is at least partly integrated in the cover or, however, constructed completely outside the cover.

In a preferred embodiment the monitoring device is integrated at least partly in the cover. In that case, for example, a sensor can be mounted on the cover and an evaluating unit similarly belonging to the monitoring device can be arranged completely outside the cover. The component of the monitoring device which is integrated in the cover can in that case be arranged on the surface of the cover and/or in the material of the cover therein.

According to a further embodiment the monitoring device comprises a light barrier which is so arranged that a light beam is interrupted or freed by deformation of the cover.

In a further embodiment the monitoring device comprises a proximity sensor in order to ascertain deformation of the cover by the support means. Such a proximity sensor can, for example, be arranged laterally adjacent to the cover.

In a further embodiment the monitoring device comprises a pressure sensor which ascertains deformation of the cover by the support means. Such a pressure sensor can, for example, be arranged at a side wall of the cover.

In a further embodiment the monitoring device comprises an electrical circuit. In a preferred form of embodiment the electrical circuit is so arranged on the cover that the electrical circuit is interrupted by breakage of the cover at a frangible location. The electrical circuit comprises at least one electrical conductor track which can be arranged on a surface of the cover or in the cover. Such electrical conductor tracks can, for example, be applied to the cover by a coating method.

Electrical conductor tracks can be applied in different ways to the cover. In a first embodiment the electrical conductor tracks are cast in place in the cover. In a second embodiment the electrical conductor tracks are glued to the cover. In a third embodiment the cover consists partly of conductive plastics material. In a fourth embodiment the electrical conductor tracks are applied to the cover by a coating method. Depending on the form of cover a different method for application of electrical conductor tracks can be suitable.

A monitoring device which comprises an electrical circuit has the advantage that it can be realized economically. In addition, such an electrical circuit can be integrated in the safety circuit of the elevator installation.

In order to be able to detect a temporary deformation of the cover the monitoring device according to one embodiment comprises a bridging element which through deformation of the cover changes from a first position to a second position so that the deformation of the cover is ascertainable by determination of the position of the bridging element. Different kinds of monitoring devices are, in principle, also conceivable for such an arrangement. In a preferred embodiment the monitoring device here as well comprises an electrical circuit. In that case, the bridging element, when it is in the first position, closes the electrical circuit and opens the electrical circuit when it is in the second position.

In an advantageous form of embodiment the bridging element in the first position bridges over a first side wall of the cover with a second side wall of the cover.

Elevator installations can be of different design. For example, there are elevator installations without a counterweight and elevator installations with a counterweight. The monitoring device described here is in principle usable in many different types of elevator installations. Preferably, such a monitoring device is employed at covers of deflecting rollers disposed at a car. However, it is also conceivable to employ such a monitoring device at a cover which is arranged at a deflecting roller at a counterweight. In addition, such a monitoring device is preferably used in elevator installations with belt-like support means.

The object is in addition fulfilled by a method of monitoring a support means in an elevator installation in which a support means is guided via a drive and a deflecting roller, wherein a cover is arranged at the deflecting roller and wherein the cover at least partly covers the support means running in or running out at the deflecting roller. The method comprises the steps of monitoring the cover by a monitoring device, which can ascertain deformation of the cover, and generating a report if the monitoring device ascertains deformation of the cover.

A report can be, for example, an electrical signal, an acoustic signal, an electronic signal or a mechanical signal, which is transmitted by the monitoring device itself or by another component in the elevator installation such as, for example, the elevator control.

In an advantageous form of embodiment the method is used in an elevator installation with an above-described monitoring device.

DESCRIPTION OF THE DRAWINGS

The invention is explained in more detail symbolically and by way of example on the basis of figures, in which.

DETAILED DESCRIPTION

Figure 1:
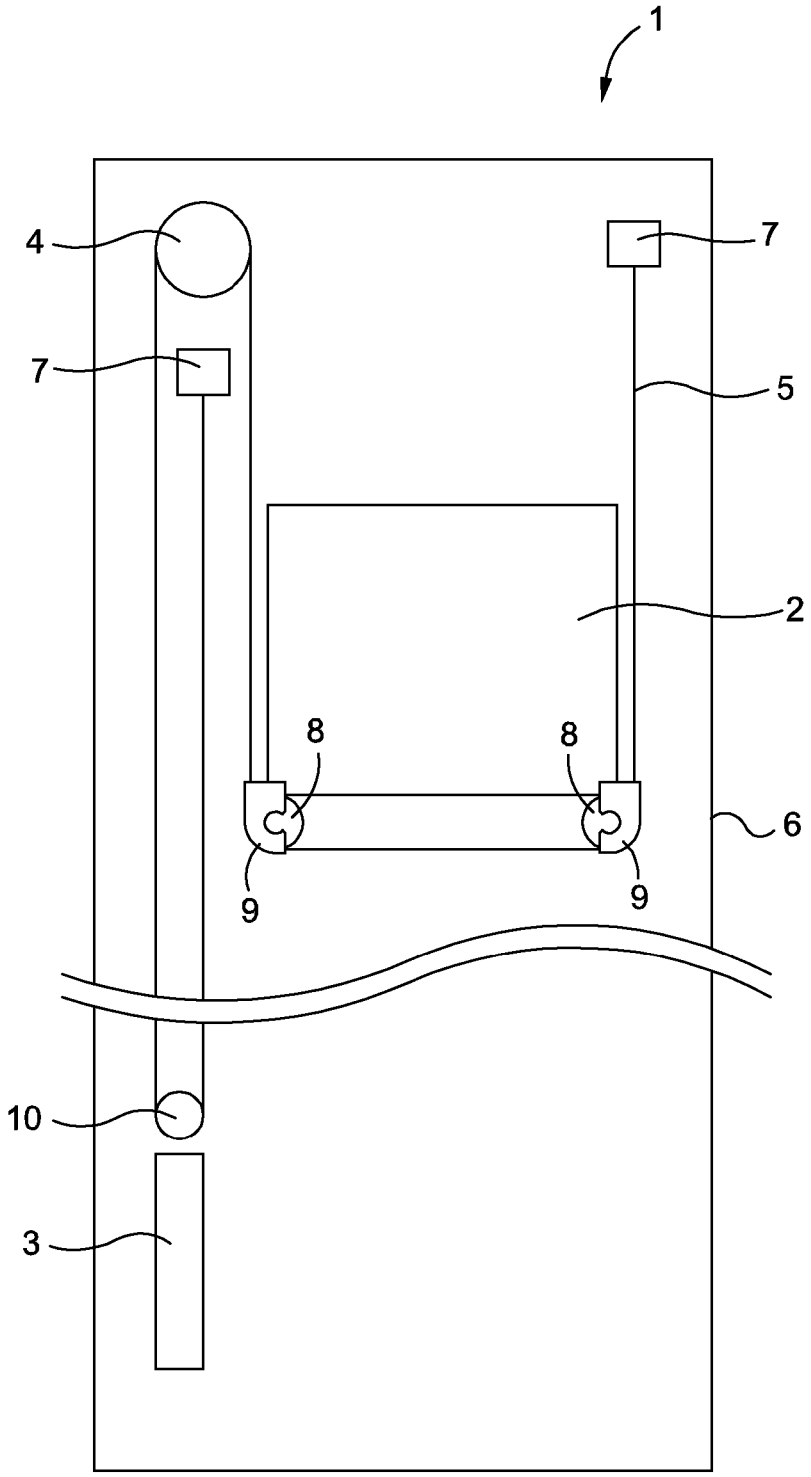
FIG. 1 shows a schematic illustration of an exemplifying elevator installation.

An exemplifying form of embodiment of an elevator installation 1 is illustrated in FIG. 1. The elevator installation 1 comprises a car 2, a counterweight 3, a drive 4 and a support means or apparatus 5. In that case the support means 5 is fixed in the elevator installation by a first support means fastening 7, guided via a counterweight guide roller 10, guided via the drive 4, guided via two car deflecting rollers 8 and again fastened in the elevator installation 1 by way a second support means fastening 7. A respective cover 9 is arranged at each of the car deflecting rollers 8. In this embodiment the elevator installation 1 is arranged in a shaft 6.

The exemplifying elevator installation 1 in FIG. 1 comprises a counterweight 3. In an alternative form of embodiment, which is not illustrated, the elevator installation does not comprise a counterweight. Moreover, numerous other forms of embodiment of an elevator installation are possible.

Figure 2A:
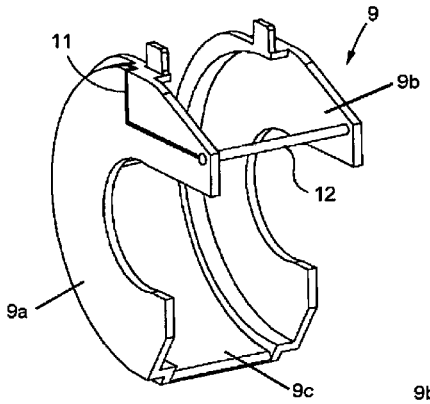
FIGS. 2*a* to 2*d* show a schematic illustration of an exemplifying cover with a monitoring device.
Figure 2B:
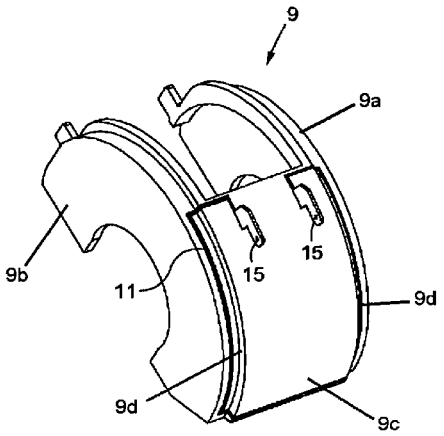
Figure 2C:
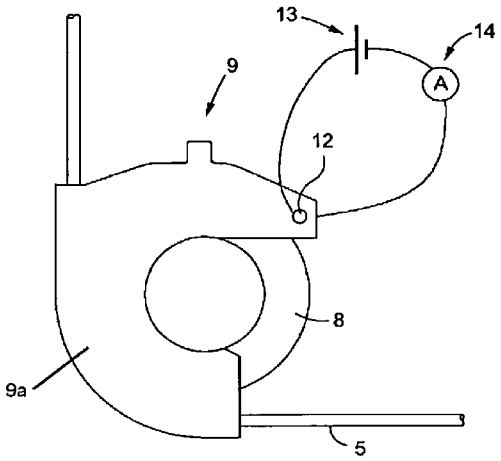

A respective cover 9 with a monitoring device is illustrated in each of FIGS. 2*a* to 2*c*. In FIG. 2*c* there is also illustrated additionally to the cover 9 a car deflecting roller 8 and a support means section 5, as well as a voltage source 13 and an ammeter 14. In the embodiment in FIG. 2*b*, the monitoring device comprises electrical conductor tracks 11 arranged on the cover 9. In the embodiment in FIG. 2*c* the monitoring device comprises a bridging element 12. In the embodiment in FIG. 2*a* the monitoring device comprises not only electrical conductor tracks 11 on the cover 9, but also a bridging element 12.

In FIG. 2*b*, electrical conductor tracks 11 are arranged on the surface of the cover 9. The cover 9 comprises a first side wall 9*a* and a second side wall 9*b* and a sub-member 9*c*, which connects the first side wall 9*a* with the second side wall 9*b*. It was observed that the cover 9 broke most frequently where a side wall coincides with the sub-member 9*c* connecting the side walls 9*a*, 9*b*. The electrical conductor tracks 11 are now so arranged on the surface of the cover 9 that a breakage of the cover 9 along a frangible location 9*d* at the edge of the side walls 9*a*, 9*b* can be reliably ascertained.

The electrical conductor tracks 11 can be connected by the connecting elements 15 with a voltage source and an ammeter (not illustrated). An interruption of the electrical conductor tracks 11 due to deformation of the cover 9 can thus be ascertained that the flow of current through electrical conductor tracks 11 is measured.

Figure 2D:
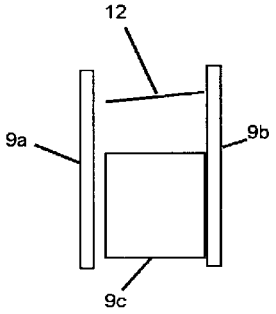

In FIG. 2*c* a bridging element 12 is arranged at the cover 9. The bridging element 12 bridges over a first side wall 9*a* of the cover with a second side wall 9*b* (see FIGS. 2*a* and 2*b*) of the cover 9. The bridging element 12 in the position illustrated in FIG. 2*c* closes a circuit with which a voltage source 13 and an ammeter 14 are connected. If the cover 9 is now deformed by a support means 5 by at least partial lateral jumping-off of the deflecting roller 8 then the bridging element 12 is transferred from a first position (see FIG. 2*a*) to a second position (see FIG. 2*d*) and the circuit is interrupted. The bridging element 12 is in that case not fixedly connected with the cover 9, but is merely clamped in place between the side walls of the cover 9.

The monitoring devices in FIGS. 2*b* and 2*c* can be combined together. Thus, in FIG. 2*a* a monitoring device is illustrated which comprises not only a bridging element 12, but also electrical conductor tracks 11. A greatest possible reliability in the detection of an at least partial lateral jumping of the support means off the deflecting roller is guaranteed by such a combination.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation including a support apparatus engaging a drive and a deflecting roller and supporting an elevator car, the support apparatus running over and being guided by the deflecting roller as the drive drives the support apparatus to move the elevator car, wherein a cover is positioned adjacent to the deflecting roller and at least partly covers the support apparatus engaged with the deflecting roller, comprising: a monitoring device integrated at least partly in the cover for sensing a deformation of the cover caused by the support apparatus at least partially laterally jumping off of the deflecting roller and contacting the cover, the monitoring device generating a report signal in response to the sensing of the deformation of the cover.

2. The elevator installation according to claim 1 wherein the monitoring device generates the report signal in response to sensing a permanent deformation of the cover.

3. The elevator installation according to claim 1 wherein the monitoring device includes an electrical circuit for sensing the deformation of the cover.

4. The elevator installation according to claim 3 wherein the electrical circuit is arranged on the cover to be interrupted by breakage of the cover at a frangible location on the cover.

5. The elevator installation according to claim 4 wherein the electrical circuit includes an electrical conductor track formed in the cover.

6. The elevator installation according to claim 3 wherein the electrical circuit includes at least one electrical conductor track arranged on a surface of the cover.

7. The elevator installation according to claim 6 wherein the electrical conductor track is arranged on the cover by a coating method.

8. The elevator installation according to claim 1 wherein the monitoring device generates the report signal in response to sensing a temporary deformation of the cover.

9. The elevator installation according to claim 8 wherein the monitoring device includes a bridging element which through deformation of the cover changes over from a first position to a second position so that the deformation of the cover is sensed by determination of the position of the bridging element.

10. The elevator installation according to claim 9 wherein the bridging element in the first position closes an electrical circuit and in the second position interrupts the electrical circuit.

11. The elevator installation according to claim 10 wherein the bridging element in the first position bridges over a first side wall of the cover and a second side wall of the cover.

12. The elevator installation according to claim 1 wherein the deflecting roller is mounted at the elevator car.

13. The elevator installation according to claim 1 wherein the deflecting roller is mounted at the elevator car and the support apparatus is of belt construction.

14. A method of monitoring a support apparatus in an elevator installation including a drive and a deflecting roller engaged by the support apparatus, the support apparatus supporting an elevator car and running over and being guided by the deflecting roller as the drive drives the support apparatus to move the elevator car, wherein a cover is positioned adjacent to the deflecting roller and at least partly covers the support apparatus engaged with the deflecting roller, the method comprising the steps of:

monitoring the cover with a monitoring device that is integrated at least partly in the cover, wherein the monitoring device senses deformation of the cover caused by the support apparatus at least partially laterally jumping off of the deflecting roller and contacting the cover; and generating a report signal from the monitoring device if the deformation of the cover is sensed.

15. The method according to claim 14 including sensing a permanent deformation of the cover and generating the report signal in response to the sensing.

16. The method according to claim 14 including sensing a temporary deformation of the cover and generating the report signal in response to the sensing.

17. The method according to claim 14 including sensing the deformation of the cover with an electrical circuit in the monitoring device.

18. The method according to claim 17 wherein the electrical circuit is arranged on the cover to be interrupted by breakage of the cover at a frangible location on the cover.

19. The method according to claim 17 wherein the electrical circuit includes at least one electrical conductor track arranged on a surface of the cover.

20. The method according to claim 17 including arranging the electrical conductor track on the cover by coating.

21. The method according to claim 17 wherein the electrical circuit includes an electrical conductor track arranged in the cover.

22. The method according to claim 17 wherein the monitoring device includes a bridging element which through deformation of the cover changes over from a first position to a second position so that the deformation of the cover is sensed by determination of the position of the bridging element.

23. The method according to claim 22 wherein the bridging element in the first position closes an electrical circuit and in the second position interrupts the electrical circuit.

24. The method according to claim 22 wherein the bridging element in the first position bridges over a first side wall of the cover and a second side wall of the cover.

* * * * *